United States Patent [19]

Stockman

[11] 4,351,392

[45] Sep. 28, 1982

[54] HEAT EXCHANGE TUBE WITH HEAT ABSORPTIVE SHIELD

[75] Inventor: Richard F. Stockman, Friendship, N.Y.

[73] Assignee: Combustion Engineering, Inc., Windsor, Conn.

[21] Appl. No.: 218,895

[22] Filed: Dec. 22, 1980

[51] Int. Cl.[3] ..... F28F 1/40

[52] U.S. Cl. ..... 165/186; 110/326; 122/44 B; 122/367 C; 138/38; 165/134 R; 165/DIG. 6; 165/DIG. 12

[58] Field of Search ..... 165/134 R, DIG. 12, 165/DIG. 6, 186, 177, 179, 183; 110/322, 323, 324, 325, 326; 122/20 B, 44 A, 44 B, 71, 62, 63, 155 R, 155 A, 136 C, 285, 367 C, 503, DIG. 3; 138/38

[56] References Cited

U.S. PATENT DOCUMENTS

| | | | |
|---|---|---|---|
| 1,117,050 | 11/1914 | Honigmann | 122/367 C |
| 2,230,221 | 2/1941 | Fitch | 122/155 A |
| 2,257,721 | 9/1941 | Dufault | 122/20 B |
| 3,353,919 | 11/1967 | Stockman | 23/277 |
| 4,167,212 | 9/1979 | Thekdi | 165/134 R |
| 4,168,737 | 9/1979 | Yoshimitsu | 165/134 R |

FOREIGN PATENT DOCUMENTS

| | | | |
|---|---|---|---|
| 2912011 | 10/1980 | Fed. Rep. of Germany | 122/44 A |
| 86913 | 10/1920 | Switzerland | 165/DIG. 6 |
| 309692 | 4/1929 | United Kingdom | 122/44 A |
| 355039 | 8/1931 | United Kingdom | 110/322 |
| 493130 | 12/1936 | United Kingdom | 165/DIG. 6 |

*Primary Examiner*—Sheldon J. Richter
*Attorney, Agent, or Firm*—William W. Habelt

[57] ABSTRACT

Method and apparatus for enhancing the heat transfer efficiency and lowering the temperature of tube walls used in a tubular gas to gas heat exchanger. The heat exchanger utilizes essentially flat sided tubes for the transfer of heat from hot gas flowing over the tubes to a cooler gas flowing therethrough. The apparatus of the invention includes a metallic heat shield inserted into the tubes between sides thereof to intercept radiation from the outer walls of said tubes and transfer it to the cooler gas flowing therethrough.

2 Claims, 4 Drawing Figures

HEAT EXCHANGE TUBE WITH HEAT ABSORPTIVE SHIELD

BACKGROUND OF THE INVENTION

Recuperative heat exchangers having flattened tubes that conduct a cool air stream to be heated in heat exchange relation with a hot gas stream flowing over the tubes, with the intent of transferring heat from the hot gas to the cooler air to be heated, are well known in the art. To achieve maximum effectiveness in such apparatus it is essential that a maximum amount of heat be transferred from the hot gas to the cooler air before the heated air stream is exhausted to its place of use. Moreover, it is important that such a heat exchanger be capable of continuous operation at highly elevated temperatures in corrosive atmospheres.

Heat exchangers used for operation in the above outlined capacity are consequently limited in effectiveness by the material from which they are made and by the extreme temperatures to which they are subjected. Thus a heat exchanger tube subjected to continuous operation at 1200° F. would usually have a much shorter life expectancy than would a tube operating at 600° F.

SUMMARY OF THE INVENTION

The present invention relates to a recuperative heat exchanger having a plurality of essentially flat sided metallic tubes that conduct a fluid to be heated through a stream of hot exhaust gases whereby heat contained in the hot exhaust gases is transferred to the cooler air. More specifically, the invention defines an arrangement that enhances the transfer of heat from the heating fluid to the fluid to be heated while it simultaneously lowers the temperature of the metallic tubes, thus increasing their life expectancy.

BRIEF DESCRIPTION OF THE DRAWING

A more complete understanding of my invention may be related by referring to the following description in conjunction with the accompanying drawing in which.

DESCRIPTION OF THE PREFERRED EMBODIMENT

Figure 1:
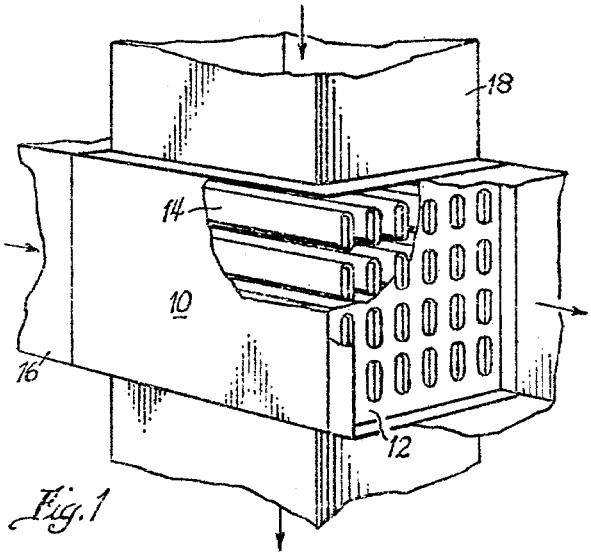
FIG. 1 is a perspective view of a heat exchanger that includes the present invention.
Figure 2:
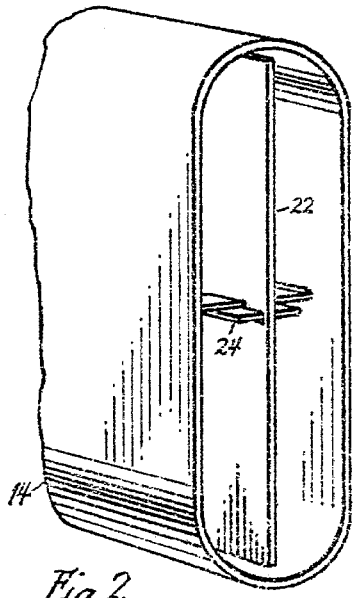
FIG. 2 is an enlarged perspective view of a heat exchanger tube including a heat shield of the present invention.
Figure 3:
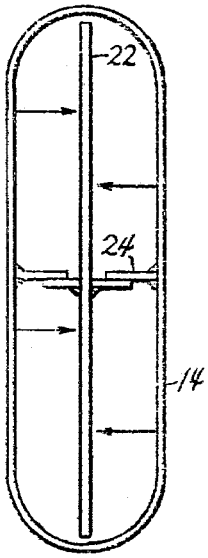
FIG. 3 is a sectional view graphically showing heat radiation in a tube according to this invention.

The invention comprises essentially a recuperative heat exchanger having a multiplicity of flat sided tubes that extend between spaced tube sheets in the manner of my previous invention U.S. Pat. No. 3,353,919 dated Nov. 21, 1967.

A heat exchanger as disclosed therein is adapted to direct an extremely hot gas over the tubes in heat exchange relation with cooler gas that contains offensive constituents in order that the offensive constituents of the gas will be rendered innocuous by the heat of the hot gas.

Since the temperature of the hot gas necessary to effect this incinerating operation may be from 1100° F. to 1500° F., the tubes contacting these hot gases are subject to constant attrition by the high temperature thereof.

While cool gas flowing through the tubes is effective in removing much heat from the hot gases flowing over the tubes, a large portion of the heat transmitted to the hot tubes is in the form of radiant energy that is not transmitted directly to the fluid within the several tubes of the heat exchanger, but instead is radiated across the hollow interior of said tubes to the opposite wall thereof such that the walls of the tubes remain extremely hot whereby they are subject to high temperature attrition.

This invention provides means in each tube that absorbs the radiant heat being transmitted by the walls thereof, thus blocking the transmission of heat by radiation from one wall to another and significantly lowering the operating temperature of the tubes while increasing their effectiveness and their life expectancy.

The invention comprises essentially a recuperative heat exchanger having a housing 10 that contains spaced tube sheets 12 between which extend a multiplicity of essentially flat sided tubes 14. The tubes are connected to an inlet 16 for a cool fluid to be heated, while hot exhaust gas or other heating fluid from inlet 18 flows over the outside of said tubes. Heat from the heating fluid is transmitted to the tubes 14, and thence to the cooler fluid flowing therethrough in order that the noxious fumes therein will be subject to combustion.

Figure 4:
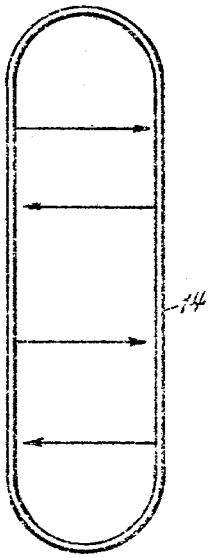
FIG. 4 is a sectional view graphically illustrating the radiation in a conventional tube.

As the temperature of the hot gas from inlet 18 reaches from 1000° F. to 1500° F., the outside walls of tubes 14 show a commensurate increase in temperature, and thus subject themselves to rapid attrition. Especially this is true as the temperature of the tubes increases and a significant amount of the heat absorbed from the hot gas is radiated across the interior of each tube from one wall to the opposite wall thereof in the manner shown by FIG. 4. As the radiant heat traverses the tube, little radiant energy is given up to the air or other cooler fluid flowing therethrough, so this heat is then absorbed by the opposite wall whereby each sidewall of the tube is absorbing radiant heat about as fast as it is losing it by radiation. Thus the temperature of each tube remains high.

This is especially true at what is called the "hot" end or "hot" side of the heat exchanger. The "hot" end of a heat exchanger is defined as that portion of the heat exchanger that lies adjacent the inlet for hot gas or the outlet for heated air. The portion of the heat exchanger lying adjacent the inlet for cool air and the outlet for the cooled gas is commonly termed the "cold" end of a heat exchanger and may be, for example, only several hundred degrees F. while the temperature at the "hot" end may range upward to from 1000° F. to 1500° F.

According to my invention I insert a heat absorbing shield 15 into an open end of each tube that is known to lie in a zone that exceeds a temperature of, for example, 1000° F. This shield may extend partially or completely through each tube from inlet to outlet and between flat walls thereof to provide a heat absorbing element that intercepts and absorbs the radiant heat being transmitted across the interior of a tube, from one wall to the other. Inasmuch as the sidewalls of the flat sided tubes 14 are thus shielded from receiving radiant heat from the opposite wall thereof, they maintain a much lower temperature so the life expectancy of the tubes together with their heat transfer effectiveness is substantially increased.

The shield 22 may be inserted in a new installation or it may be retrofitted into existing tubes and attached by spacer clips 24 to provide an increased temperature of the gases to be heated while simultaneously lowering the metal temperature of the tube itself, thus providing the above mentioned advantages.

The clips 24 may be welded to opposite tube walls as shown, they may be frictionally held in place, or they may be spring biased to position the heat absorbing shield 15 in an essentially stable condition between opposite tube walls, the exact method of attachment being no significant part of my invention.

I claim:

1. A recuperative heat exchanger that directs a fluid to be heated in heat exchange relation with a heating fluid, said heat exchanger including tube means having essentially flat sidewalls with inlet and outlet ends adapted to conduct a fluid to be heated through said tube means, means for directing a heating fluid over the outside of the tube to heat said tube by contact therewith, heat absorptive shield means positional longitudinally in said tube means between sides thereof lying essentially parallel to the flat sides of said tube, and lateral spacers confronting opposite sides of said shield adapted to hold said shield in a predetermined position.

2. A recuperative heat exchanger as defined in claim 1 wherein the heat absorptive shield is positioned in a portion of the tube means that exceeds a temperature of about 1000° F.

* * * * *

UNITED STATES PATENT AND TRADEMARK OFFICE

CERTIFICATE OF CORRECTION

PATENT NO. : 4,351,392

DATED : September 28, 1982

INVENTOR(S) : Richard F. Stockman

It is certified that error appears in the above—identified patent and that said Letters Patent is hereby corrected as shown below:

Cover Page, Item [73], change Assignee from "Combustion Engineering, Inc., Windsor, Conn." to --The Air Preheater Company, Inc., Wellsville, New York--

Signed and Sealed this

*Twenty-eighth* Day of *December 1982*

[SEAL]

*Attest:*

GERALD J. MOSSINGHOFF

*Attesting Officer*

*Commissioner of Patents and Trademarks*